United States Patent [19]

Gilmour

[11] Patent Number: 4,691,748

[45] Date of Patent: Sep. 8, 1987

[54] IMPROVED FILLER TUBE TIP AND CENTERING BELL BUSHING

[75] Inventor: Alfred J. Gilmour, Waterloo, Canada

[73] Assignee: Auto-Flush Systems Ltd., Waterloo, Canada

[21] Appl. No.: 819,278

[22] Filed: Jan. 16, 1986

[51] Int. Cl.[4] ..... B67C 3/26

[52] U.S. Cl. ..... 141/165; 141/392; 285/16

[58] Field of Search ..... 141/165, 312, 37-66, 141/250-284, 285-310, 392; 384/246, 271; 285/16, 334.1

[56] References Cited

U.S. PATENT DOCUMENTS

| | | | |
|---|---|---|---|
| 3,420,281 | 1/1969 | Tidwell | 141/40 |
| 4,349,055 | 9/1982 | DiChiara | 141/39 |

FOREIGN PATENT DOCUMENTS

| | | |
|---|---|---|
| 582604 | 9/1959 | Canada . |
| 608451 | 11/1960 | Canada . |
| 631555 | 11/1961 | Canada . |
| 689637 | 6/1964 | Canada . |
| 703649 | 2/1965 | Canada . |
| 740739 | 8/1966 | Canada . |
| 757926 | 5/1967 | Canada . |
| 770472 | 10/1967 | Canada . |
| 800449 | 12/1968 | Canada . |
| 903157 | 6/1972 | Canada . |
| 946341 | 4/1974 | Canada . |
| 983446 | 2/1976 | Canada . |
| 989365 | 5/1976 | Canada . |
| 1082659 | 7/1980 | Canada . |

*Primary Examiner*—Houston S. Bell, Jr.

*Attorney, Agent, or Firm*—Vance Marston; Stewart L. Gitler; Martin P. Hoffman

[57] ABSTRACT

Bottle filling machines are known in which a centering bell is attached to a bushing for vertical movement up and down on a filler tube. Downward movement of the bushing and bell is limited by a shoulder on an enlarged tip portion of the filler tube. The area of contact between the bushing and shoulder in prior art arrangements is a narrow circular flat area perpendicular to the long axis of the filter tube. Repeated contact between the bushing and the shoulder on the tube tip causes wear on the bushing and on the shoulder. The present invention reduces the rate of wear of the contact areas by forming the shoulder so that it slopes downwardly and outwardly an an angle of about 20° to 45° with respect to a vertical axis. The region of the bushing which engages the shoulder is also sloped downwardly and outwardly at substantially the same angle. The sloping region of the bushing may be recessed above the lower end of the bushing so that the tip portion of the filler tube is at least partially retracted inside the bushing when the bell is at its lowest position, thus reducing the likelihood of a bottle contacting the tip of the filler tube during a filling operation.

16 Claims, 2 Drawing Figures

IMPROVED FILLER TUBE TIP AND CENTERING BELL BUSHING

BACKGROUND OF THE INVENTION

This invention relates to centering bells for bottle filling machines of the type which move up and down vertically on filler tubes.

A number of manufacturers make bottle filling machines in which a centering bell rides up and down the filler tube, supported by a bushing in the centering bell which slides on the filler tube. Typically, the filler tube has an enlarged tip at its lower end with a shoulder which is contacted by the lower end of the bushing when the bell drops to its lowest position. This prevents the bell from falling off the end of the filler tube.

The areas of contact between the bushing and tube tip are narrow circular flat areas, perpendicular to the long (vertical) axis of the filler tube. Repeated contact between the bushing and the tube tip causes wear on the contact areas. In some cases, with heavy centering bells on a high speed filler, this wear can be extreme, with worst cases having a bushing life of less than two weeks.

Canadian Pat. No. 983,446 of Alexander R. Duncan, issued Feb. 10, 1976, shows a bell of this type in FIGS. 1 and 2, which relate to admitted prior art for that patent. The invention of the patent (FIG. 3 thereof) eliminates the shoulder on the tip of the filling tube and secures the bell in the top position so that it does not move up and down. However, this obviously eliminates the desirable centering function of the bell when a bottle approaches and begins to encircle the filler tube.

FIG. 2 of Canadian Pat. No. 989,365 of Alexander R. Duncan, issued May 18, 1976, shows an arrangement in which the centering bell moves up and down on the filler tube but, instead of an enlarged tip at the end of the filler tube, he uses a collar 6 adjacent the upper end of the tapered tip of the filler tube. However, a clip such as disclosed by Duncan would be subject to high wear problems, just as would a shoulder at the top of the tip portion of the filler tube. In this patent, Duncan refers to modern filling machines as operating at high speeds of, e.g., within the range of 725–750 b.p.m. While such speeds may have been considered "high" when Duncan filed his patent application in 1974, some bottle filling machines now operate at speeds up to 1200 b.p.m. Thus, what Duncan considered high speed is now considered relatively low.

In today's high speed bottle filling machines it is more than ever necessary to guard against contact between a bottle and a filler tube which could chip or break the bottle or possibly damage the filler tube. Because of the high speed of the equipment there is little time for a bottle to be properly centered with respect to a filler tube. The arrangement of Duncan's above-mentioned Canadian Pat. No. 983,446 eliminated the initial centering action of the bell by securing it in position at the top of the filler tube. Even though he reduced the size of the tip of the filler tube, there is a danger of metal-to-glass contact, particularly in today's high speed filling machines.

SUMMARY OF THE INVENTION

The present invention provides an arrangement which greatly reduces the wear between the bushing and the shoulder at the top of the tip of the filler tube.

In accordance with a broad aspect of the invention there is provided, in a bottle filling machine of the type in which a centering bell is secured to a bushing for slidable movement along a vertical axis on each of a plurality of filler tubes, each filler tube having an enlarged tip portion with a top shoulder engageable by the lower end of the bushing to limit downward movement of the bell, the improvement wherein said shoulder slopes downwardly and outwardly at an angle of about 20° to 45° with respect to said vertical axis and a region of said bushing which engages said shoulder slopes downwardly and outwardly at substantially the same angle.

A preferred value for the above-mentioned angle is about 30°.

The surface areas which come in contact are now conical so that, given the same major and minor diameters, and an angle of 30°, the surface areas are now twice that of the old style bushing-filler tube combination. The conical or tapered inside contact surface on the bushing, which contacts the matching tube-tip shoulder, has the effect of greatly increasing bushing life by doubling the contact area and by causing the contact "blow" to be at an oblique angle, rather than at right angles to the plane of the surface.

Centering bells in high-speed bottle filling machines are heavier than in slow-speed machines to ensure that they drop quickly to the ends of the filler tubes after a filled bottle is withdrawn. Light weight bells, because of their shape, tend to "parachute" down. However, the rapidly falling heavy bells cause the wear problem discussed above, which problem is ameliorated by the present invention.

As the inside diameter, or bore, of the bushing wears (where it contacts the filler tube itself as the centering bell slides up and down), the conical taper still continues to properly center the centering bell in relation to the filler tube while the centering bell is resting on the tube tip. This "self-centering" property is not present in the prior art design and, as the bushings wear, an "off center" aspect can occur, which leads to improperly centered bottles, in turn causing chipped necks on the bottles if the filler tube-tip strikes the glass necks of the bottles.

Because the bushing of the present invention lasts longer, it in turn increases the life of the centering bell, since much of the wear on the bell is caused by the periodic replacement of its bushing.

The conical surface on the inside of the bushing can be recessed above the bottom end of the bushing so that when the bell is at its lowest position, the tip of the centering tube is at least partially retracted within the bushing, thus reducing the likelihood of it striking the neck of a bottle to be filled. By the time the bottle has been raised high enough to start lifting the bell, the bell has centered the bottle so that the filling tube can enter the mouth of the bottle without contacting it.

BRIEF DESCRIPTION OF THE DRAWINGS

The invention will now be further described in conjunction with the accompanying drawings, in which.

DESCRIPTION OF THE PREFERRED EMBODIMENT

Figure 1:
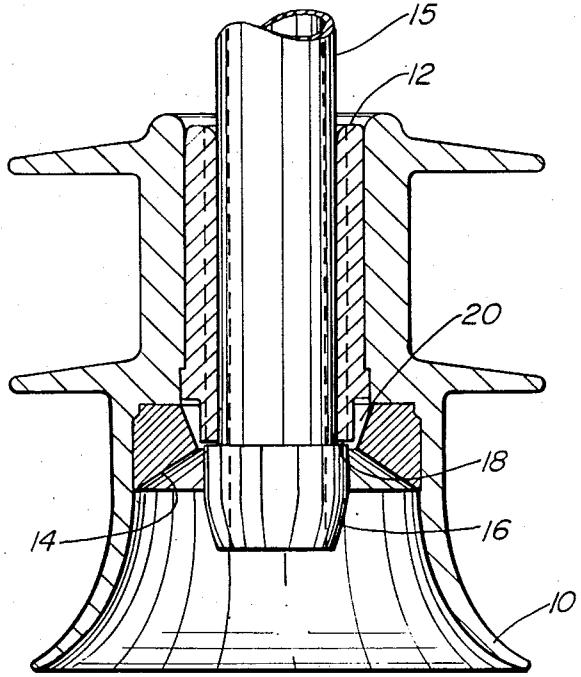
FIG. 1 is an elevational view, partly in cross-section, of a prior art centering bell, bushing and filler tube.

Referring to FIG. 1, there is shown a prior art centering bell 10 fitted on a bushing 12 and having a generally annular sealing ring 14 of elastomeric material such as rubber. The bushing 12 encircles a filler tube 15 having an enlarged tip portion 16 which has a flat circular shoulder region 18. When a bottle, not shown, is lowered after filling, the bell 10 drops and its downward movement is limited by the bottom end of the bushing 12 striking the shoulder 18 on the enlarged tip 16 of the filler tube 15.

FIG. 1 shows the inner surface of the sealing member 14 as being tapered. Normally, such sealing members do not have a tapered internal surface, but some users cut such a tapered surface so that the sealing ring can easily be inserted into or removed from the bell 10 and around the lower part of the bushing 12. This does, however, mean that the resulting space 20 could accumulate dirt or liquid in which moulds or bacteria might grow, which is obviously not desirable.

Figure 2:
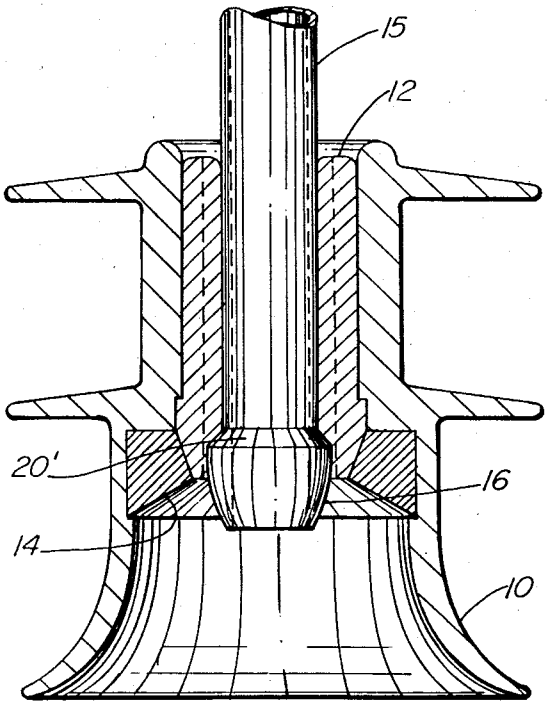
FIG. 2 is an elevational view, partly in cross-section, of a centering bell provided with a bushing and filler tube in accordance with the present invention.

Referring to FIG. 2, which illustrates the present invention, it will be noted that the bell 10 and sealing member 14 are the same as in FIG. 1, but here the shoulder 20' is not flat as in FIG. 1, but rather slopes downwardly and outwardly at an angle between 20° and 45°, preferably 30°. A matching surface is machined on the inside of the bottom portion of the bushing 12 and this matching surface can be recessed above the lower end of the bushing 12 as shown in FIG. 2. Recessing the tapered surface on the bushing 12 results in the tip 16 of the filler tube being at least partially recessed within the bushing 12 when the bell is at its lowest position, shown in FIG. 2. Because of this, a bottle entering the centering bell can be properly centered before it reaches the filler tube, thus greatly reducing any chance of the bottle hitting the filler tube.

To eliminate the gap 20 shown in FIG. 1, the outer surface of the lower end of bushing 12 is tapered downwardly and inwardly. The sealing ring is easily inserted in or removed from the mouth of the bell 10 and there is no gap to become contaminated.

The bell 10 may be made of any suitable material such as metal or plastic, the particular material not being important as far as the principles of the present invention are concerned. The bushing 12 and filler tube 15 may be formed of stainless steel but, again, the particular material is not critical.

It will be noted that the space 20 in FIG. 1 is defined by a cut-out portion at the bottom of the bushing 12, which portion 20 is eliminated in FIG. 2 because of the outside taper on the bottom of the bushing 12. As a result, the lower end of the bushing 12 of the invention is stronger than that of the prior art as shown in FIG. 1.

The bell and bushing could be formed as an integral unit, but then the entire unit would eventually have to be replaced instead of just the bushing.

Other advantageous attributes of the present invention have been discovered as a result of tests on a 120 valve filler operating at about 1200 bottles per minute.

As the bottles are lowered to be discharged from the filler, the centering bells would normally continue to rest on the top of the bottle until the bells reach the lower limit of their travel on the filler tube. However, at the very high speed at which this filler runs, the centering bells are not able to drop as rapidly as the bottles are lowered owing to a slight residual friction drag initially and possibly also its tendency to catch air in the manner of a parachute, thus slowing its descent. Even so, by the time the bell does reach the end of the filler tube, it has now accelerated, and it strikes the filler tube tip more forcefully than if it had followed the bottle all the way down.

With the conventional tube tip and bushing configuration, the centering bell bounces a few times on the tube tip before coming to rest. Hence, there are three to four impacts occurring for each bottle to be filled on the valve. This phenomenon was clearly observed with the aid of a strobe light, but was previously an unknown factor. It helps explain the accelerated bushing wear being experienced on these latest high-speed machines.

However, the arrangements of the present invention behave much differently. Not only do the bushings wear better, for all the previously mentioned reasons, but also they do not bounce in this particular instance, which eliminates the added wear experienced by the prior art bushings in the bells which bounce three or four times.

In arrangements according to the present invention the rebound energy from the initial impact is directed essentially sideways owing to the angled contact surface, a direction in which the bell is not free to move. Hence, no bounce.

This also means that the bell will come to rest sooner, paving the way for even higher speeds without fear that the bell would not be in a proper position to receive the next incoming bottle. With prior art arrangements, the last bounce ends uncomfortably close to this point.

What I claim as my invention is:

1. In a bottle filling machine having a centering bell with a bushing for slidable movement along a vertical axis on each of a plurality of filler tubes, wherein each filler tube has an enlarged tip portion with a top shoulder for engagement with the lower end of said bushing in said bell to limit downward movement of the bell, the improvement wherein said top shoulder has a downward and outward slope of about 20° to 45° with respect to said vertical axis and wherein a region of said bushing has a downward and outward slope of about 20° to 45° with respect to said vertical axis whereby the top shoulder of said tip portion and the region of said bushing smoothly contact to reduce bouncing of the bell and increase bushing life.

2. The improvement as claimed in claim 1 wherein said region is at the lower end of said bushing.

3. The improvement as claimed in claim 1 wherein said region is near the lower end of said bushing.

4. The improvement as claimed in claim 3 wherein said angle is about 30°.

5. The improvement as claimed in claim 1 wherein said region is recessed above the lower end of said bushing whereby said tip portion is at least partially retracted inside said bushing when said bell is at its lowest position.

6. The improvement as claimed in claim 4 wherein said region is recessed above the lower end of said bushing whereby said tip portion is at least partially retracted inside said bushing when said bell is at its lowest position.

7. The improvement as claimed in claim 6 wherein said bushing has a tapered region on its outer surface at its lower end engageable by a mating region on a generally annular sealing member disposed in the upper part of said bell.

8. In a bottle filling machine having a centering bell with a bushing for slidable movement along a vertical axis on each of a plurality of filler tubes, wherein each filler tube has an enlarged tip portion with a top shoulder for engagement with the lower end of said bushing in said bell to limit downward movement of the bell, the improvement wherein said top shoulder has a downward and outward slope of about 20° to 45° with respect to said vertical axis whereby the top shoulder of said tip portion and the region of said bushing smoothly contact to reduce bouncing of the bell and increase bushing life.

9. The improvement as claimed in claim 8 wherein said angle is about 30°.

10. In a bottle filling machine having a centering bell with a bushing for slidable movement along a vertical axis on each of a plurality of filler tubes, wherein each filler tube has an enlarged tip portion with a top shoulder for engagement with the lower end of said bushing in said bell to limit downward movement of the bell, the improvement wherein a region of said bushing has a downward and outward slope of about 20° to 45° with respect to said vertical axis whereby the top shoulder of said tip portion and the region of said bushing smoothly contact to reduce bouncing of the bell and increase bushing life.

11. The improvement as claimed in claim 10 wherein said region is at the lower end of said bushing.

12. The improvement as claimed in claim 10 wherein said region is near the lowered end of said bushing.

13. The improvement as claimed in claim 12 wherein said angle is about 30°.

14. The improvement as claimed in claim 10 wherein said region is recessed above the lower end of said bushing whereby said tip portion is at least partially retracted inside said bushing when said bell is at its lowest position.

15. The improvement as claimed in claim 13 wherein said region is recessed above the lower end of said bushing whereby said tip portion is at least partially retracted inside said bushing when said bell is at its lowest position.

16. The improvement as claimed in claim 15 wherein said bushing has a tapered region on its outer surface at its lower end engageable by a mating region on a generally annular sealing member disposed in the upper part of said bell.

* * * * *